United States Patent [19]

McGill

[11] 3,971,190

[45] July 27, 1976

[54] ARTICLE TRANSFER APPARATUS HAVING RELEASABLE RODS

[75] Inventor: Robert W. McGill, Munroe Falls, Ohio

[73] Assignee: A-T-O Inc., Willoughby, Ohio

[22] Filed: Feb. 20, 1975

[21] Appl. No.: 551,266

[52] U.S. Cl. ..... 53/77; 53/166; 53/247; 214/1 BT

[51] Int. Cl.[2] ..... B65B 57/00; B65B 35/38

[58] Field of Search ..... 53/166, 77, 247, 248; 214/1 BB, 1 BT; 294/6 S

[56] References Cited

UNITED STATES PATENTS

| | | | |
|---|---|---|---|
| 2,863,579 | 12/1958 | Meyer | 214/1 BB |
| 3,601,951 | 8/1971 | Bargel et al. | 53/248 X |
| 3,648,427 | 3/1972 | Raudat et al. | 53/247 X |
| 3,721,352 | 3/1973 | Messmer | 214/1 BT |

*Primary Examiner*—Robert L. Spruill
*Attorney, Agent, or Firm*—Oldham & Oldham Co.

[57] ABSTRACT

The article depositing and transferring apparatus has a plurality of rows of abutted containers fed to a grid or a carrier means at a processing station where a vertically movable control means having a plurality of individual push or transfer rods releasably attached thereto is provided. Suction cups releasably attach push rods individually to the control means whereby when the control means is driven vertically downwardly, the individual rods engage individual articles on the grid and forcibly move them downwardly for article deposit action, but if an obstruction is encountered the rods individually release and permit the remainder of the apparatus to function normally. Or the rods may have end members to engage the articles for controlled transfer or deposit of the same.

This invention generally relates to article packaging or caser apparatus.

8 Claims, 6 Drawing Figures

ARTICLE TRANSFER APPARATUS HAVING RELEASABLE RODS

BACKGROUND OF THE INVENTION

In the processing of containers, bottles, cans and other articles which are packaged in multiple article cases for shipment or handling, normally streams of the articles to be packaged are fed in abutted rows to a grid or packaging head for assemblying the articles into case filling groups. One typical apparatus for processing articles in this manner is shown in U.S. Pat. No. 3,052,071.

When these articles are assembled in case filling groups, the grid mechanism heretofore available has been actuated to permit the articles to drop as groups into a carrier case positioned below the grid. However, in some instances where plastic bottles or other lightweight containers, such as empty bottles or cans, are being deposited into carrier containers, frequently these articles will not readily drop or move through the associated drop fingers provided on the grid. The grids normally have a plurality of spring drop fingers positioned below each drop area or opening in a grid to guide the articles to the associated carrier case. The articles must individually drop through a set of drop fingers to reach the carrier case.

Since apparatus of this type must function automatically and rapidly to package large numbers of articles into cases in a short period of time, to have no malfunctioning in the article deposit, and to fill each case with full complements of articles, it has been difficult to process all types of sizes, weights or shapes of articles rapidly for full automatic drop of a group of case filling articles. Also, in some instances, it is desirable to pick up or grasp a group of articles and move them positively to a carrier case or other member.

The general object of the present invention is to provide novel and improved article deposit apparatus characterized by having a plurality of individually releasable rods or tubular members provided in the apparatus for individual engagement with and action on articles to be deposited into a carrier case or other member.

Another object of the invention is to provide suction retaining forces on individual article engaging rods for releasably securing the same to a vertically movable carrier means used for forcing or moving articles on a grid down into a carrier case through the grid, but to avoid damage to the apparatus should any article or container not move through the grid mechanism properly.

Another object of the invention is to provide a push rod and carrier manifold assembly means in article deposit apparatus whereby individual suction and/or air pressure forces can be provided for the individual push rods for controlling article engaging, movement and/or deposit action of the individual articles of a group of articles in case packer apparatus by means on the lower ends of the push rods.

A further object of the invention is to provide relatively uncomplicated, easily controlled apparatus having a good service life with minimum maintenance to aid in article deposit action for filling cases with lightweight articles, such as empty cans, or the like.

The foregoing and other objects and advantages of the invention will be made more apparent as the specification proceeds.

Reference now is particularly directed to the accompanying drawings, wherein.

In referring to corresponding members shown in the drawings and referred to in the specification, corresponding numerals are used to facilitate comparison therebetween.

Figure 1:
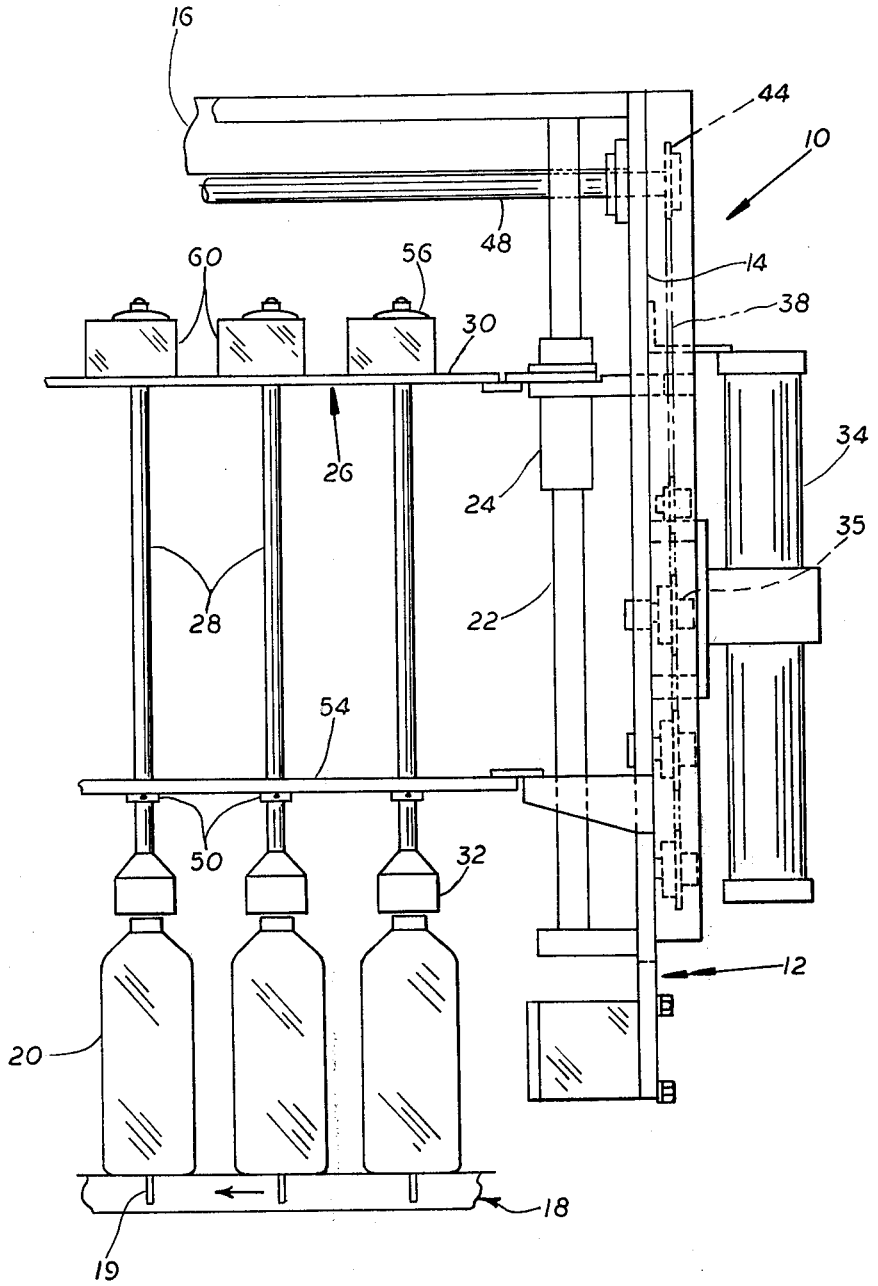
FIG. 1 is a fragmentary elevation of apparatus embodying the principles of the invention.

The apparatus shown is usually used in association with known article caser apparatus, such as shown in U.S. Pat. No. 3,052,071.

The article deposit apparatus of the invention is indicated as a whole by the numeral 10. Such apparatus 10 includes a suitable fixed frame means 12, only a portion of which is shown in the drawing and which frame means includes a lateral upright 14 of a suitable length and a top bar or beam member 16 that extends across the apparatus and a conveyor (not shown) which feeds articles to the apparatus for packaging. The top bar 16 connects to a second upright, similar to the upright 14, at the opposite side of the apparatus. This apparatus 10 straddles an article support means or grid member that has laterally movable support bars indicated at 18 for each row of abutted articles. Such article support 18 normally comprises a grid of the type shown in U.S. Pat. No. 3,052,071 wherein a plurality of streams of abutted articles are fed into the grid to be supported thereon while being formed in a group of articles for filling a carrier case or equivalent container. The articles are moved by a conveyor or other known means so as to be slid onto support bars 19 in the article support, which bars are moved laterally out from under the articles as the articles are retained stationarily positioned through the grid, for article drop into the carrier case positioned under the grid. The specific support bars 19 are moved in a conventional manner. A plurality of typical containers 20 are shown positioned on the grid 18 and they are formed into a suitable article group for deposit into the associated carrier case to fill the same.

The frame or apparatus includes a cylindrical upright 22 at each side thereof and a sleeve 24 slidably engages such rod or cylinder 22, which upright is suitably secured to the frame 12. A carrier means 26 extends transversely of the apparatus for carrying a plurality of individual article engaging push rods or tubes 28 that are arranged in a group corresponding to the group of articles formed on the grid 18 for deposit into the carrier container. Such carrier means 26 includes a crossbar 30 attached at its opposite ends to the individual sleeves 24 on opposed sides of the apparatus. The crossbar 30 and all members attached thereto are positioned for suitable length vertical movement towards and away from the grid. Normally, the carrier means 26 when at its uppermost position, as indicated in FIG. 1, has the lower ends of the push bars or tubes 28 and any suction cup or contactor means 32 thereon positioned slightly above the upper ends of the containers 20 on the grid.

Figure 2:
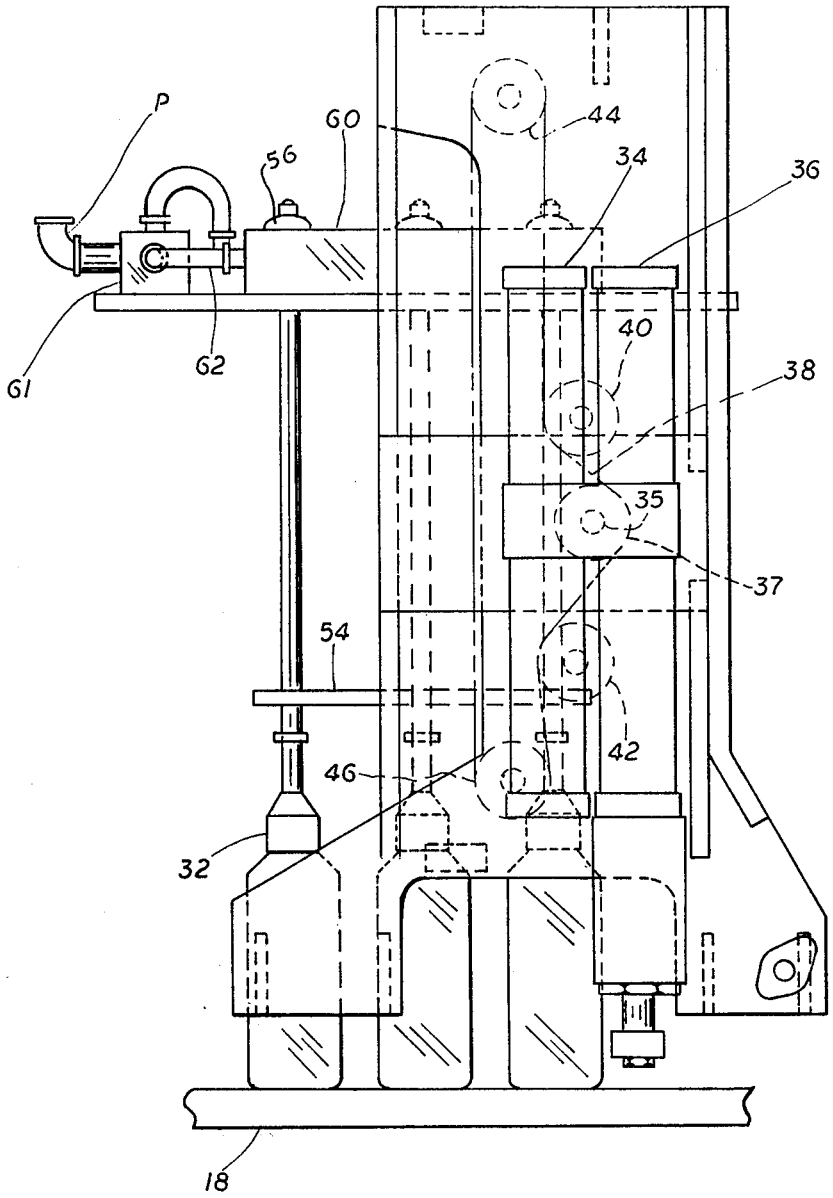
FIG. 2 is a side elevation of the apparatus of FIG. 1.

Controlled vertical movement for the carrier means 26 and all members positioned thereon is provided by any suitable means and FIGS. 1 and 2 of the drawings show that a pair of drive cylinders 34 and 36 are operably secured to the upright 14. Any suitable source of pressure fluid is supplied to actuate the cylinders and move the pistons therein and rack gears connecting thereto for driving, through a suitable common connecting pinion gear (not shown) or equivalent, a pinion gear shaft 35 that has a sprocket 37 secured thereto. Such shaft 35 can be journaled on the frame upright 14. The sprocket 37 engages an endless chain 38 to drive the same. Such chain 38 extends around guide sprockets 40 and 42 journaled on the upright 14 and to upper and lower sprockets 44 and 46. The upper sprocket 44 is secured to a transversely extending shaft 48 journaled on the frame and extending across the conveyor supplying articles to the grid 18 and engaging a similar sprocket and drive chain positioned on the opposite side of the apparatus. Hence, drive of the chain conveyor 38 from the power cylinders 34 and 36 is transmitted to the opposite side of the apparatus and such drive of the chains 38 controls the vertical position and movement of the carrier means 26 and members positioned thereon.

Conventional control means supply pressure fluid to the power cylinders 34 and 36 in a timed manner for actuation of the drive chains 38 in relation to coordinated timed action or movement of the grids 18 and associated means to release the containers 20 on the grids for drop action. Slightly before the containers 20 are released, the carrier means 26 is actuated to be moved down towards the grid. After the contactor means 32 engage the containers 20, the containers are released and the carrier means 26 are again driven to move downward further. Then any containers 20 not dropping readily or being pushed or moved through the grid in a normal manner will cause the individual push rods 28 to be moved with relation to the carrier means, as hereinafter described.

It will be realized that the individual push tubes 28 are provided in sufficient numbers and are so positioned for individual engagement of one push member or tube with each of the containers carried on the grid 18 for drop to, or controlled positioning in, the associated carrier case.

Further features of the carrier means 26 are that the individual push members or tubes 28 each have reset means operatively associated therewith and including a collar 50 secured to each tube adjacent the individual suction cups or contactors 32 at the lower ends of each of these tubes 28. The individual tubes 28 extend slidably through a crossbar 54 suitably secured to and extending between the pair of uprights 14 at a fixed vertical position above the collars 50 whereby when the carrier means 26 is moved downwardly, there is no action by the collars 50. But when the carrier means 26 is moved to its uppermost position, at that time the collars 50 should abut on the under surface of the crossbar 54 and insure that the upper ends of the tubes 28 are positioned so that suction cups 56 thereon are in good engagement with an associated flat upper surface portion of the carrier means, as hereinafter described.

For tube 28 control, the carrier means 26 includes a plurality of manifold units or means 60 operatively carried by the crossbar or plate 30. Such manifolds have individual pressure and/or vacuum supply tubes 62 connecting thereto from a distributor 61 that connects to sources (not shown) of below and above normal air pressure. Such pressures or forces are transmitted to the individual manifolds, one of which is provided for each row of articles in the article group. Air pressures are transmitted through a bore 64 formed in the manifold and extending longitudinally thereof. The bore 64 connects to each of a plurality of supply bores or holes 66 extending transversely of the manifolds and connecting individually to bores 68 extending vertically through the manifolds 60. Each bore 68 suitably positions one of the pusher tubes 28 slidably therein for vertical movement. Substantially U-shape in section upper and lower gaskets or seals 72 and 74 are carried by the manifolds in each bore 68 to engage longitudinally spaced portions of the individual pusher tubes 28 and seal the tubes in the bores 68 to control the air pressure forces supplied thereto. The seals 72 and 74 have edge sealing lips 73 that may extend upwardly or downwardly to seal against a tube 28. The upper seal 72 always has its lip 73 extending downwardly to aid in drawing a vacuum under the suction cup 56. The lip 73 of the lower seal 74 extends downwardly when a vacuum is the operative force supplied by the bore 66 to the bore 68 but the seal is positioned to have the lip 73 extend upwardly when a positive air pressure is the normal operative force (as hereinafter described).

All of the pusher tubes 28 have center bores 76 extending the length thereof and connecting to a center bore in an end plug or connector means 29 engaging the upper ends of the tubes. A plurality of inlet bores 78 connect the bore of the end plug 29 to the periphery of the tube adjacent the upper end thereof to form connections for receiving vacuum or pressure forces supplied by the bore 64 to the periphery of such pusher tube by feeder bores 66. Such bores 78 horizontally align with the bore 66 when the pusher tube or member is in its normal operative position. The upper ends of the tubes 28 are of any suitable construction to engage the manifolds to receive pressures therefrom.

The suction cups 56 are individually secured to the upper ends of each of the pusher tubes as by a capscrew 80 or the like engaging the end plug 29. The suctional force, when supplied to the pusher tube and manifold assembly, will aid in drawing the suction cup 56 for such tube down into tight engagement with an associated flat top surface 84 of the manifold due to the downward inclination of the sealing lip 73 to the seal 72.

Figure 3:
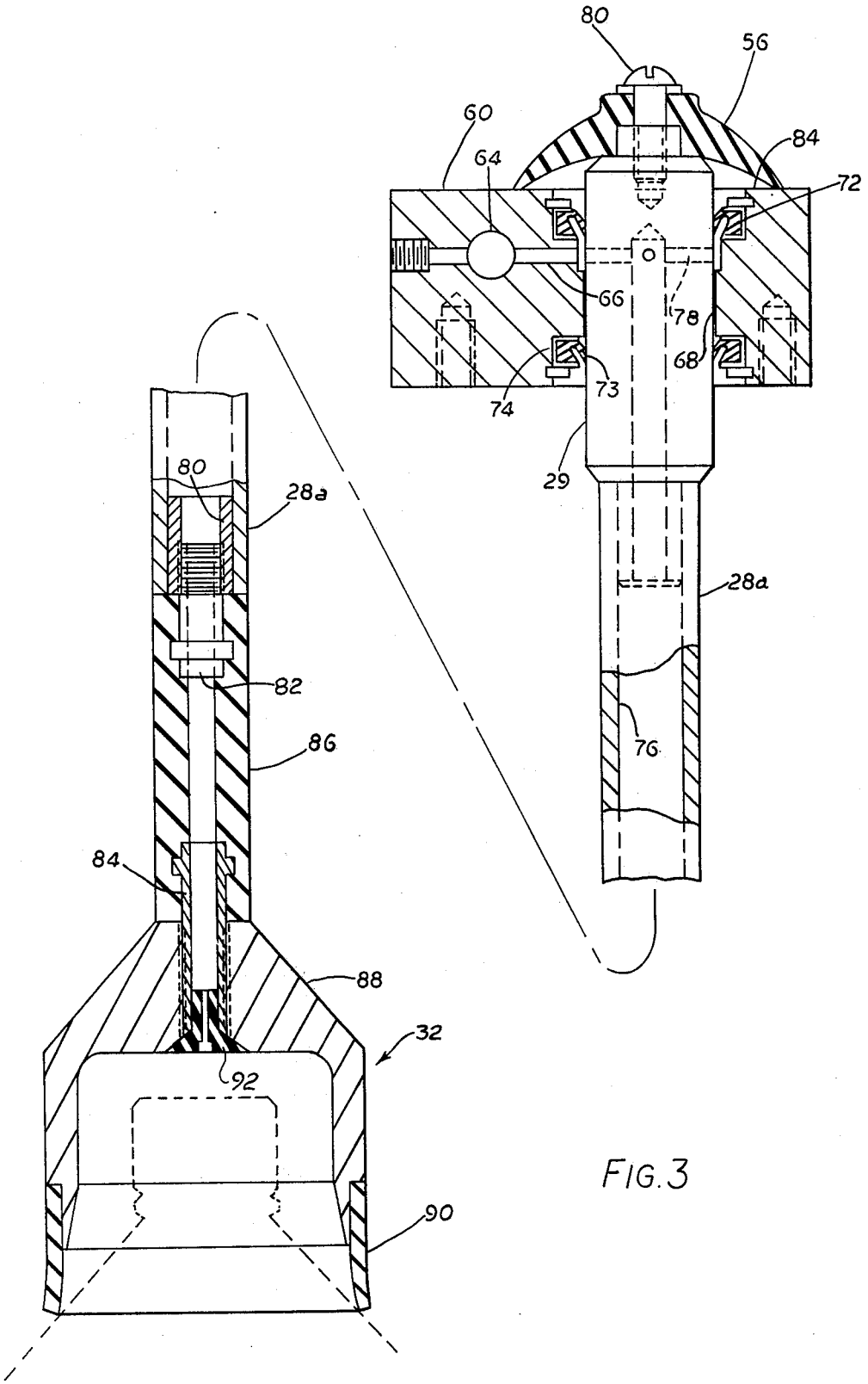
FIG. 3 is a broken away vertical section through a pusher rod or tube and the carrier manifold.
Figure 4:
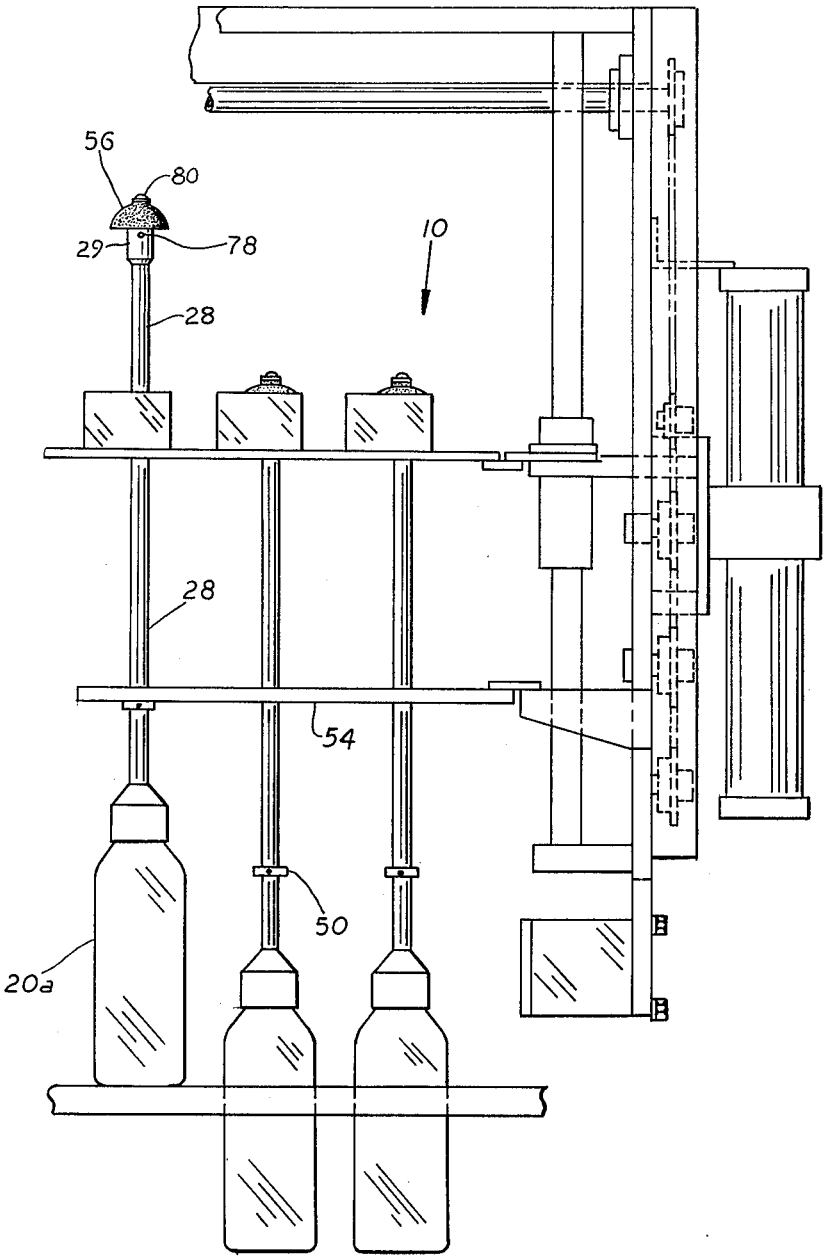
FIG. 4 is a fragmentary elevation, like FIG. 1, but showing the pusher mechanism moved down to article engaging and pushing position.

The suctional or air pressure force provided is transmitted to the lower end of each of the pusher tubes 28 for use thereat. The suction cup means 32 provided on the lower end of each of the pusher tubes will physically engage the pusher tube with an associated container, and FIG. 3 shows a section of a typical positioning means therefor. The pusher tube 28 has an end sleeve 80 secured in its lower end and tapped to engage a threaded tubular stud 82. Such stud and a lower similar stud 84 are bonded to opposite ends of a resilient rubber sleeve 86 which is not shown in the smaller drawings of the tubes (FIGS. 1, 2 and 4). A metal cup 88 threadably engages a protruding section of the lower stud 84 and has a resilient rubber sleeve 90 carried by and protruding from its lower end. Such sleeve is adapted to contact and seal, under suction, against the upper end of one of the containers 20. A tubular metal or plastic plug 92 is positioned in the lower end of the lower stud 84 and preferably has a small diameter center bore for transmitting pressure or vacuum forces slowly to and from the enclosure formed by the cup and sleeve 90 as engaged with a container.

By slidably engaging the individual pusher tubes with the manifold 60, when any resisting force greater than that set up by the suction cup 56 is exerted on an individual pusher tube, then such tube will be released as the carrier means 26 is moved downwardly. In other words, if the lower end of the pusher tube assembly has struck or is in engagement with an article or container which is not moving smoothly and readily through the grid or associated support member 18 when the grid is in its released position, then the individual pusher rods are released by forcing the suction cups 56 out of engagement with the manifold surface 84 and that rod or tube engaging the container 20*a* does not move further downwardly, as indicated in FIG. 4 of the drawings. This avoids interference with the article pushing and depositing action of the other individual push rods or tubes.

It will be realized that controlled air pressure or vacuum forces can be provided from suitable supply sources connected to the distributor 61 by a pipe or line P. Suction forces from such line flow to the suction sleeves 90 to secure containers thereto but when the container has been moved down into a carrier case, then the pressure controls for the line P shift to supply atmospheric air or air pressure thereto. This breaks the sleeve 90 out of engagement with the container and gently releases it in its given position.

Figure 5:
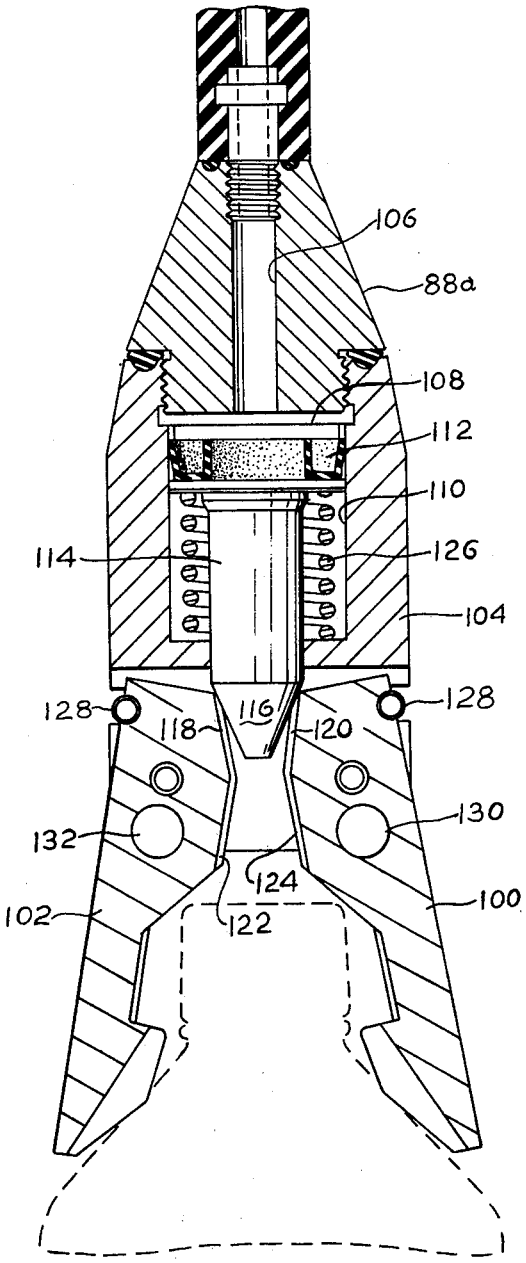
FIG. 5 is a vertical section of an article engaging head carried by a pusher tube.

In some instances, it is desirable to use the push rods of the invention for actual grasp of the containers 20 on the support 18 for container movement or deposit action. Thus, a pair of mechanically actuated physical gripping fingers or jaws 100 and 102, FIG. 5, are pivotally mounted on the lower end of a sleeve 104 that attaches to a modified metal cup 88*a*. Air pressure supplied to the tube 28 flows through the bore 106 of the cup 88*c* to control a piston 108 in a cylinder 110 formed in the sleeve 104. The piston is sealed in the cylinder 110 by a seal means 112 and a piston, pin or rod 114 extends downwardly from the piston. The piston rod 114 has a conical lower end 116 that engages lead in cam surfaces 118 and 120 of the gripper jaws to start to force them together. The jaws 100 and 102 are moved to operative positions when air pressure is set up in the control cylinder 110 to force the piston 108 further downwardly and bring its end 116 into contact with diverging lower cam surfaces 122 and 124 on the gripper jaws adjacent their pivot pins 130 and 132 secured to and extending across opposed slots in the sleeve 104. Such jaws 100 and 102 are released on release of the air pressure and a spring 126 returns the piston 108 to its upper position. A coil spring 128 engages the sleeve 104 and extends around it to engage upper portions of the jaws 100 and 102 to open the same as the piston rod is raised. The tube positioning the gripper head assembly of FIG. 5 may be square in section and engage its positioning manifold by its cylindrical top plug 29. Thus, when gripper means are secured to the lower end of such square tube, they can be maintained in desired positions for grasping the proper circumferential portion of rectangular, oblong, square, etc., shaped containers.

The seals 72 and 74 maintain a good sealing engagement with the pusher rod or tube at both the upper and lower margins of the manifold 60 for maintaining the desired slidable pressure or vacuum sealed engagement with the pusher tube 28 or end plug 29 and associated means. But for the assembly of FIG. 5, the lip 73 of the seal 74 would extend upwardly.

Figure 6:
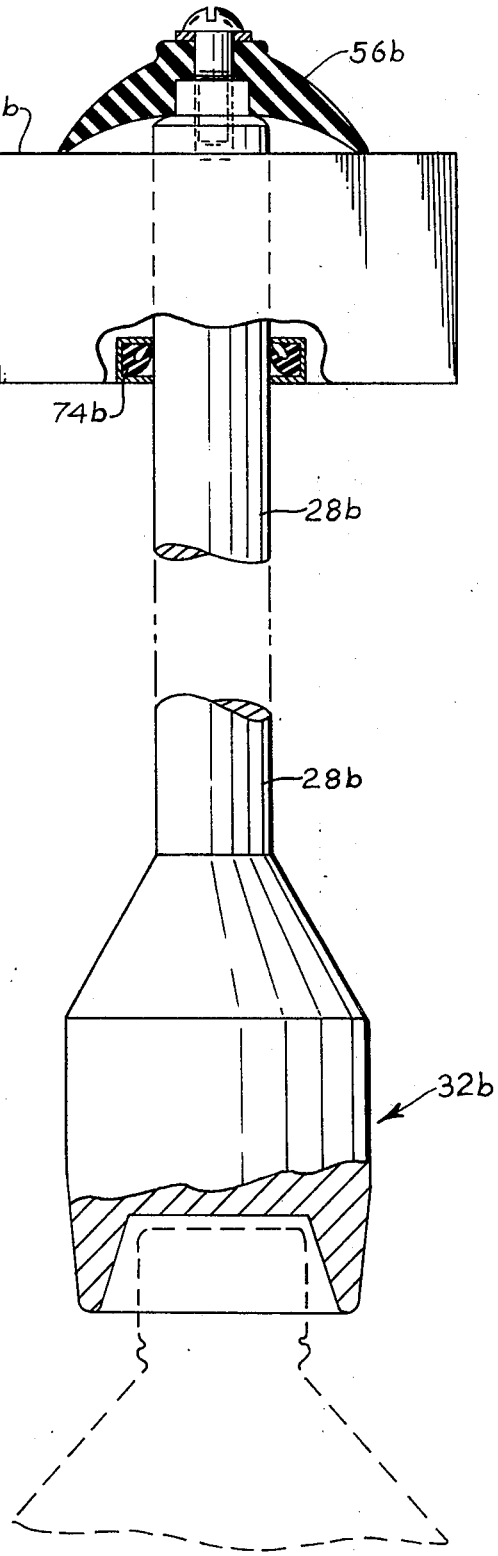
FIG. 6 is a broken away view, partly in vertical section, of a pusher rod.

Re FIG. 6, a modified manifold 60*b* is provided in which a push rod 28*b* is slidably positioned. The rod 28*b* usually has no center bore but it carries a top suction cup 56*b* at its upper end for individual rod attachment and release, as before. Only a lower seal 74*b* is required in the manifold. The rod 28*b* is designed to provide a pusher assist action by a contactor 32*b* at its lower end. Such contactor 32*b* may be a modified metal cup like the cup 88 and secured to the push rod 28*b* in the same general manner as shown in FIG. 3. Hence, the contactor 32*b* will just engage an individual article to aid in pushing it through a grid down into a carrier case. The contactor 32*b* obviously can be of any suitable design.

All of the pusher rods or tubes of the invention have reset means including collars 50 secured thereto. These collars are suitably spaced from the support means 18 to be positioned to engage the reset bar 54 when the carrier means 26 is returned to its upper position and force the suction cups 56 into good engagement with the positioning manifold. Details of the collars and resilient positioning means for the article engaging heads on the pusher tubes are too small to be shown in some drawings or are omitted for clarity. The article engaging heads on the pusher tubes preferably are flexibly positioned in all embodiments of the invention.

The apparatus of the invention is readily adapted for article or container deposit action by mechanical or air pressure forces and safety release suction cup means are provided for the individual push rods, or tubes. Hence, it is believed that the objects of the invention have been achieved.

While several complete embodiments of the invention have been disclosed herein, it will be appreciated that modification of these particular embodiments of the invention may be resorted to without departing from the scope of the invention.

What is claimed is:

1. In container depositing or case packer apparatus or the like having articles fed onto a releasable support at an article processing station in a plurality of rows of abutted articles, the combination comprising a frame means, a carrier means slidably engaging said frame means for vertical movement, said carrier means extending across said support at the processing station and being thereabove, drive means engaging said carrier means to control its position and move it vertically toward and away from said support, manifold means on said carrier means and having vertical bores therein and having a fluid pressure force supplied to said bores, a plurality of vertically positioned pusher rods individually slidably engaging said bores of said manifold means and protruding therefrom in both directions but being movable as a unit with said carrier means, and a suction cup member on the upper end of each of said pusher rods to engage said carrier means to releasably secure each operably positioned pusher rod thereto for individual movement of said pusher rods, said manifold means operatively transmitting a vacuum fluid pressure force to said suction cup members to aid in operatively positioning the same.

2. In a container depositing or case packer apparatus, as in claim 1, the improvement comprising reset means operatively connected between said frame and said pusher rods to engage inoperably positioned individual pusher rods and reset them with suction cups engaging said carrier means on return upward movement of said carrier means.

3. In container depositing or case packer apparatus or the like as in claim 1 where said pusher rods are tubular, connector means are present on the upper ends of said pusher rods to engage said manifold means, fluid pressure actuated article engaging means are carried at the lower ends of said pusher rods, and said connector means and pusher rods transmit said fluid pressure force to said article engaging means.

4. In a container depositing or case packer apparatus, as in claim 3, the improvement comprising said pusher rods being made of metal, and resilient means attaching said article engaging means to said pusher rods to aid in article engaging action.

5. In a container depositing or case packer apparatus, as in claim 4, the improvement comprising the said article engaging means including a metal cup extending downwardly from a said push rod and connecting to the bore thereof, a substantially tubular suction sleeve carried by said metal cup and extending downwardly therefrom for article engaging action, and a tubular plug having a relatively small diameter bore positioned in the air flow path from a said push rod to said suction sleeve to restrict air flow therebetween.

6. In a container deposit apparatus or the like as in claim 1, wherein a group of articles are collected on said support, the plurality of said pusher rods are positioned in the same pattern as said group of articles with each pusher rod being directly above an article for engagement therewith when said carrier means is moved towards said support to urge the articles individually to move downwardly, said pusher rods being individually secured to said manifold means solely by said suction cup members.

7. In container depositing or case packer apparatus or the like having articles fed onto a releasable grid support at an article processing station in at least one row of articles, the combination comprising a carrier means above said grid support at the processing station and vertically movable with relation thereto, drive means engaging said carrier means to control its position and move it vertically towards and away from said support, a plurality of vertically positioned tubular pusher rods positioned individually vertically above individual articles at said article processing station, manifold means on said carrier means having a plurality of vertical bores extending therethrough each slidably and operatively individually engaging a said pusher rod to supply a fluid force thereto, article engaging members carried by said pusher rods at the lower ends thereof and connecting to the fluid force supply to set up individual forces on such members to control article engaging action thereby, a suction cup member being provided on the upper end of each of said pusher rods to engage a flat upper surface on said manifold means when said carrier means is at its uppermost position, and reset means positioned on said frame means and on said pusher rods to engage the individual said pusher rods and reset them, if required, with said suction cups engaging said carrier means on return upward movement of said carrier means.

8. In container depositing or case packer apparatus as in claim 7 where said reset means comprises a horizontal cross bar operatively slidably engaging said pusher rods, and collars on each of said pusher rods to engage said cross bar and limit vertical movement of said pusher rods with said carrier means.

* * * * *